US011835257B2

(12) United States Patent
Weir et al.

(10) Patent No.: US 11,835,257 B2
(45) Date of Patent: Dec. 5, 2023

(54) ROOF VENT DEVICE

(71) Applicants: Adam Manley Weir, Southampton (CA); Jason Hugh Simpson, Southampton (CA)

(72) Inventors: Adam Manley Weir, Southampton (CA); Jason Hugh Simpson, Southampton (CA)

(73) Assignee: Thinkers Research and Development Inc., Southampton (CA)

( * ) Notice: Subject to any disclaimer, the term of this patent is extended or adjusted under 35 U.S.C. 154(b) by 0 days.

(21) Appl. No.: 17/240,774

(22) Filed: Apr. 26, 2021

(65) Prior Publication Data

US 2021/0348782 A1 Nov. 11, 2021

Related U.S. Application Data

(60) Provisional application No. 63/015,016, filed on Apr. 24, 2020.

(51) Int. Cl.
*F24F 7/02* (2006.01)

(52) U.S. Cl.
CPC ..... *F24F 7/02* (2013.01); *F24F 2221/14* (2013.01)

(58) Field of Classification Search
CPC ..... F24F 7/02; F24F 2221/14
See application file for complete search history.

(56) References Cited

U.S. PATENT DOCUMENTS

| | | | | |
|---|---|---|---|---|
| 3,683,785 | A | 8/1972 | Grange | |
| 3,797,180 | A | 3/1974 | Grange | |
| 4,280,399 | A * | 7/1981 | Cunning | E04D 13/174 454/365 |
| 4,446,661 | A | 5/1984 | Jonsson | |
| 4,635,419 | A | 1/1987 | Forrest | |
| 4,817,506 | A | 4/1989 | Cashman | |
| 5,092,225 | A * | 3/1992 | Sells | E04D 13/174 454/365 |
| 5,361,551 | A * | 11/1994 | Post | E04D 13/178 52/302.1 |
| 5,947,817 | A * | 9/1999 | Morris | E04D 1/36 454/365 |
| 6,015,343 | A * | 1/2000 | Castillo | E04D 13/174 454/365 |
| 6,447,392 | B1 | 9/2002 | Henderson | |
| 7,562,498 | B2 | 7/2009 | Galeazzo | |
| 8,292,707 | B2 | 10/2012 | Grisham | |

FOREIGN PATENT DOCUMENTS

GB 2131846 6/1984

* cited by examiner

*Primary Examiner* — Jessica Yuen
(74) *Attorney, Agent, or Firm* — Eugene F. Derenyi

(57) ABSTRACT

A roof vent device for use with a ceiling rafter is provided. The roof vent device provides apertures to provide for fluid flow to ventilate the roof space of ceilings.

7 Claims, 12 Drawing Sheets

EFVS-107
2017-07-28

TOP VIEW

SIDE VIEW

BOTTOM VIEW

EFVS-120
2019-02-21

FRONT

ALL DIMEMSIONS IN MM

ROOF VENT DEVICE

CROSS-REFERENCE TO RELATED APPLICATIONS

This application claims the benefit of U.S. Provisional Application No. 63/015,016 filed on Apr. 24, 2020, and the entire disclosure of which is incorporated herein by reference.

FIELD

The present disclosure relates to a roof vent device, in particular a roof vent device for cathedral style ceilings.

BACKGROUND

The intent of roof venting varies depending on climate. In a hot climate, the primary purpose of ventilation is to expel solar-heated hot air from the attic or roof deck to reduce the building's cooling load and to relieve the strain on air-conditioning systems. In a cold climate, the primary purpose of ventilation is to maintain a cold roof temperature to avoid ice dams created by melting snow and to vent any moisture that moves from the conditioned living space to the attic or roof deck. In mixed climates, ventilation serves either role, depending on the season.

In cold climates, preventing condensation within the insulated ceiling structure of moisture condensed from the hot, moist inside air within the building is a major problem. Heat loss is typically a combination of air leakage and conductive losses. This is particularly true in vaulted interior ceiling constructions where frequently, insufficient vented air circulation, or in some cases no ventilation, is provided between the insulated portion of the roof structure and the cold outside exposed roofing layer.

Additionally, hot, moist air within the building can condense within the insulated ceiling structure. Vaulted interior ceilings, in particular, lack vented air circulation between the insulated portion of the roof structure and the cold outside exposed roofing layer. These cathedral or sloped ceilings in buildings, while aesthetically appealing, suffer from ventilation problems. In particular, ceilings with features such as hips, valleys, and dormers contribute to a complex roof geometry that exacerbates ventilation issues. These ceilings can result in heat or air loss, create ice dams, or encourage condensation.

Typical roof construction presently provides ventilation from the facia or eaves to the ridge in an upward linear fashion up through the rafter bays providing a series of vertically extending passages. The air passes upwardly along the under surface of the roof deck and between the rafters which act as channels for the air to flow. These ventilation channels are created by installing a vent baffle, vent chute and vent channel or the like between the insulation and roof sheathing to maintain a separation or vent space. However, adequate ventilation is not always easily obtained in geometrically complex roof structures leaving areas of roof structures that are inadequately vented or without any ventilation.

This is, as mentioned above, particularly true in the vaulted ceiling construction and found in areas such as hips, valleys, dormers, skylights and any other area which may not have adequate ventilation, if any, due to its complex geometrically shaped design. In present construction methods, a hip or valley section of a roof has the same general construction leading to a condition where the communication between vent spaces is not easily achieved and making unvented areas common. Thus, the formation of ice dams is commonly present in these locations as well as moisture and mold, which commonly form in these unvented rafter bays. These unvented areas of a roof system can also decrease shingle life due to its inability to shed or relieve the heat build-up that is commonly seen in warmer climates or in the warmer months of northerly climates as well.

Other efforts at addressing these problems include devices as disclosed in UK Patent Application GB2,131,846A in the name of Catnic Components Limited ("Catnic"). Catnic discloses a device for attachment to a roof rafter to provide a cross-flow ventilation channel for the roof. FIG. 1 is a perspective view illustrating the Catnic device. As shown in FIG. 1, two channel shaped devices are joined to form generally a "tube" or "tunnel" positioned on the rafter adjacent the eaves. This allows for improved air flow from the eaves to the roof space. The Catnic device provides passage for air flow from the eaves to the roof space to improve air flow. Catnic, while providing air flow associated with the underside of a roof is directed at introducing outside air flow which may not be desirable in certain climates.

Many other devices similarly direct air flow between the exterior and interior as below. For example, U.S. Pat. No. 5,947,817 in the name of Morris et al. ("Morris") discloses a ventilating system for a roof made of multi-plied weatherproof material that has air passages. While providing air flow, Morris seeks to vent air between the interior and exterior of a structure.

U.S. Pat. No. 4,817,506 in the name of Cashman ("Cashman") discloses a ventilator placed along a roof ridge for venting the internal atmosphere in an enclosure such as an attic. In this case, air is exhausted from the attic through the roof ridge. This device, then, has openings to direct air from the interior to the exterior.

U.S. Pat. No. 3,683,785 in the name of Grange ("Grange") discloses a roof construction that provides air flow along the underside of the roof deck from the facia to the ridge. Air then flows upwardly along the roof deck to an outlet at the ridge of the roof. Similar to the device of Cashman, air is directed to the exterior.

U.S. Pat. No. 8,292,707 in the name of Grisham et al. ("Grisham") discloses an off-peak intake vent to ingest air into the attic space from the edge of the roof. This device, then, draws in air from the exterior which is not necessarily desirable in all climates.

U.S. Pat. No. 7,562,498 in the name of Galeazzo et al. ("Galeazzo") discloses a roof vent configured to cover a ventilation opening formed in a roof deck. Again, similar to the device in Cashman, directs air from the interior to the exterior to avoid issues such as mold caused by moisture condensation.

U.S. Pat. No. 6,447,392 in the name of Henderson ("Henderson") discloses a vent device that similar to the concept in Catnic above directs air from the environment outside to an opening communicating with its interior.

U.S. Pat. No. 3,797,180 discloses a ventilated roof construction providing a baffle having a plurality of channels placed between the roof deck and the rafter for directing air flow outwardly to escape the dwelling.

Other devices provide for ventilation between the roof and the insulation. For example, U.S. Pat. No. 4,446,661 in the name of Jonsson ("Jonsson") discloses a sheet formed as a spacer means for creating air gaps between the roofing insulation and a roof. This device provides for controlled ventilation by placing a corrugated sheet as a spacer between the insulation and the roof.

Additionally, U.S. Pat. No. 4,635,419 in the name of Forrest ("Forrest") discloses a vented roof construction provided with a series of vented air circulation passages between the outer roofing layer and an inner sealed insulation layer to prevent the accumulation of moisture within the insulated inner portion of the roof structure. Forrest, while providing ventilation, seeks to provide a ventilating system between the outer cold air roof structure and the inner insulated roof structure to prevent accumulation of moisture on the outer surface of the insulated inner roof structure.

Accordingly, a device is desired that addresses at least one of the above issues.

SUMMARY

In one aspect of the disclosure, a roof vent device for use with a ceiling rafter is provided. The roof vent device comprises an elongated base for attachment to the rafter. At least one arm extends away from the base for separating the rafter from the ceiling. The arm has apertures for providing for fluid flow. In another aspect, in the roof vent device said elongated base further includes two side flanges depending therefrom to form a channel for embracing said ceiling rafter. In a still further aspect, said at least one arm consists of a first arm extending substantially parallel to a second arm, each arm extending from each side flange. In a still further aspect, the device, further includes a web connecting said first arm and said second arm. In a still further aspect, in the roof vent device, wherein said web is substantially parallel to said base for forming a passage for fluid flow. In a still further aspect, in the roof device, said web has apertures for providing for fluid flow. In a still further aspect, in the roof device, said at least one arm and said base are integral. In a still further aspect, in the roof vent device, said base and said side flanges are integral. In a still further aspect, in the roof vent device, said web and said base are integral. In a still further aspect, in the roof vent device, said channel is formed of metal. In a still further aspect, in the roof vent device, the device is formed from a plastics material.

In a another aspect of the disclosure, a roof vent device for use with a ceiling rafter, said roof vent including at least two arms extending generally in parallel in an angled formation forming angled joints, for separating the rafter from the ceiling, a spacer joining said at least two arms at opposing the angled joints, and said at least two arms having apertures for providing for fluid flow. In a further aspect, in the roof vent device, the two arms extend generally in parallel in a repeating angled formation. In a still further aspect, in the roof vent device, the two arms extend generally in parallel in a zig-zag formation. In a still further aspect, in the roof vent device, the apertures are of repeating shapes.

BRIEF DESCRIPTION OF THE DRAWINGS

These and other features of the invention will become more apparent from the following description in which reference is made to the appended drawings wherein.

DETAILED DESCRIPTION

Figure 1A:
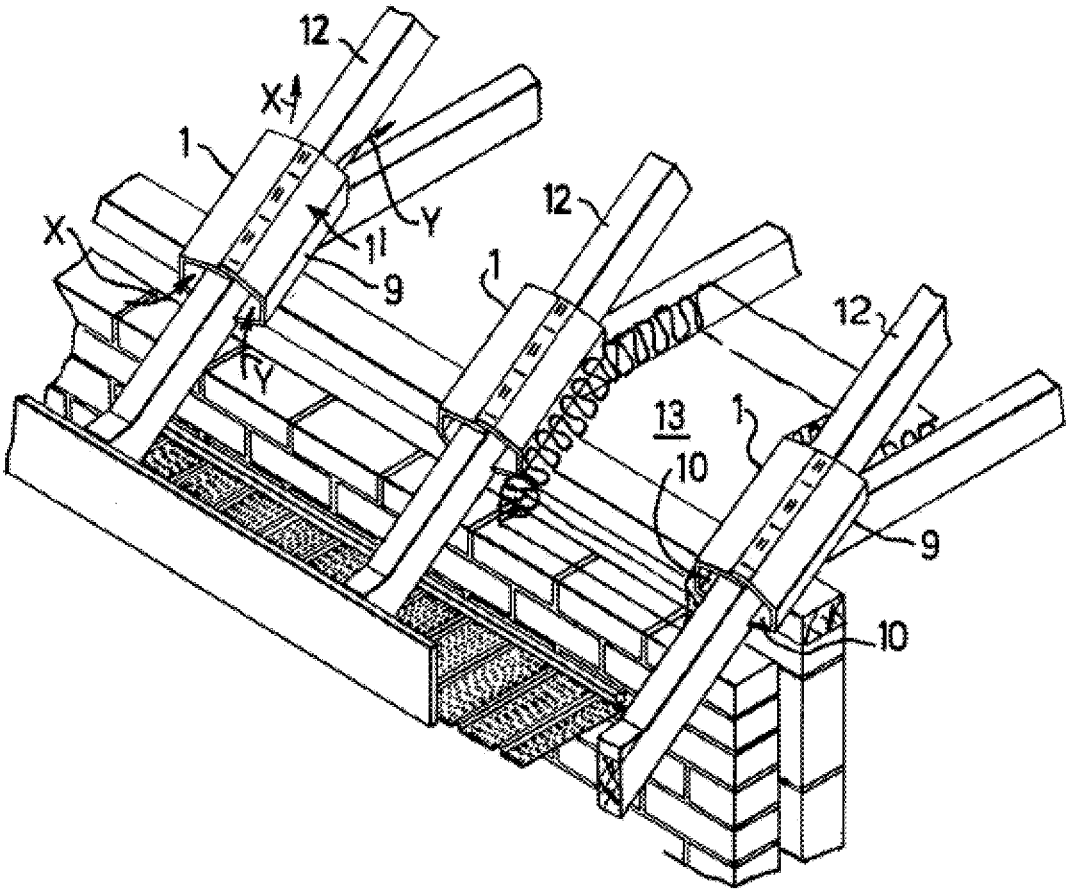
FIG. 1A (PRIOR ART)
FIG. 1A shows a perspective view of a roof vent device as shown in Catnic.
Figure 1:
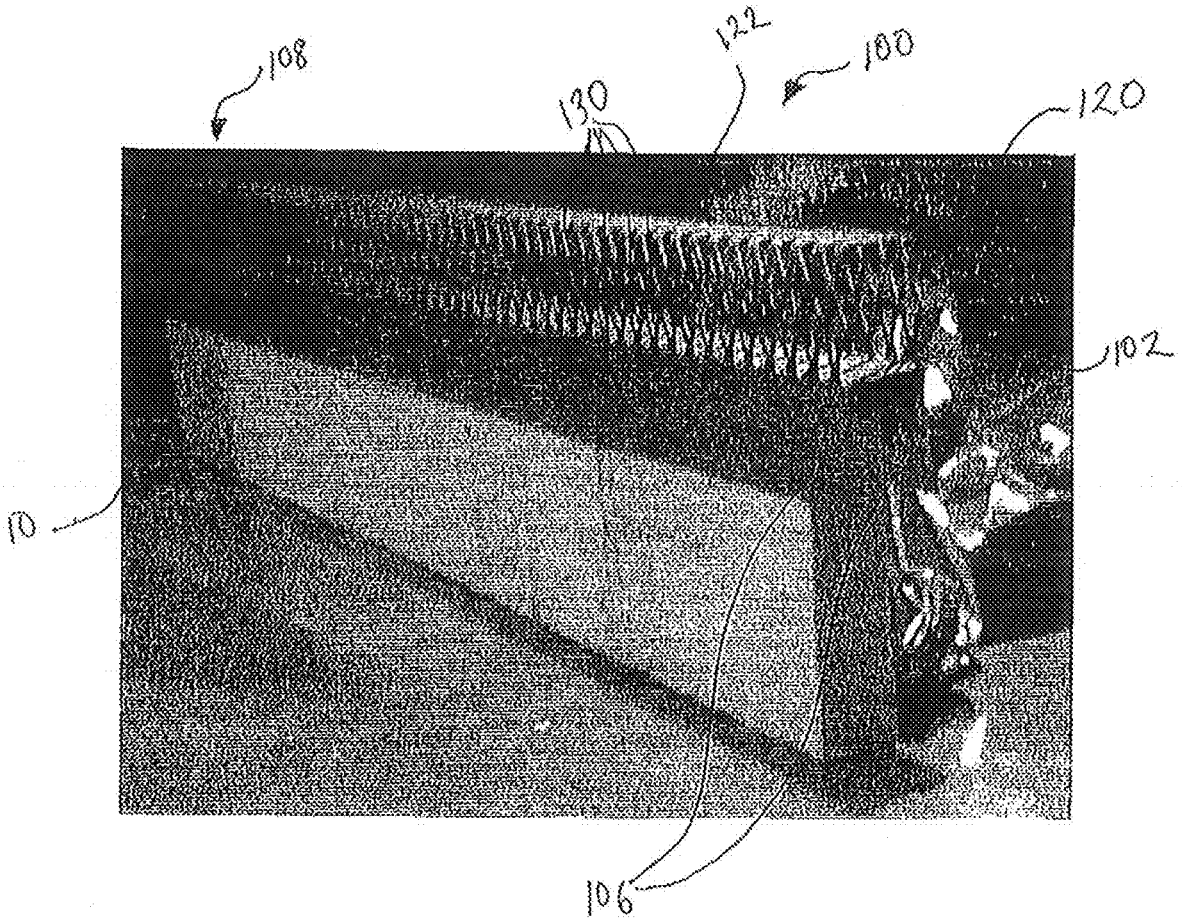
FIG. 1 shows a perspective view of a roof vent device secured to a rafter in accordance with an embodiment of the present invention.
Figure 2:
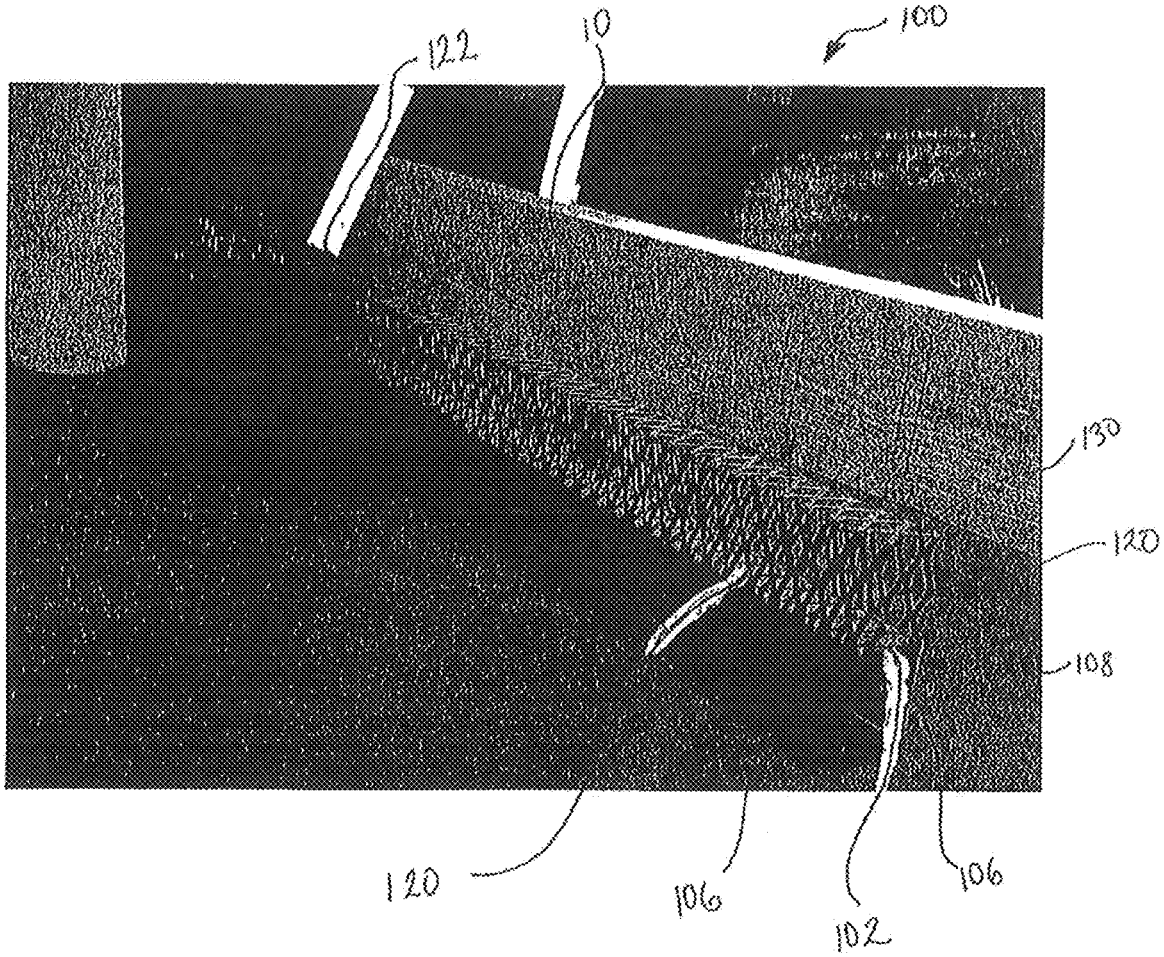
FIG. 2 shows a perspective view of the roof vent device of FIG. 1 separated from the rafter.

The present disclosure provides a roof vent device indicated generally by the reference numeral 100 in the accompanying figures. The roof vent device 100 for use with a ceiling rafter 10 comprises an elongated base 102 for attachment to the rafter 10. The base 102 may run the length of the entire rafter 10 as shown in the accompanying figures, or it may run along only a portion of the rafter 10. As shown, the base 102 attaches to the top edge of the rafter 10.

The base 102 may further comprise at least two opposite side flanges 106 depending therefrom to form a channel 108 for embracing the rafter 10. This embodiment provides for additional surface area with which to secure to roof vent device 100 to the rafter 10. The roof vent device 100 may be secured to the rafter 10 as shown, for example, in FIG. 4. The roof sheeting 14 may be connected to the rafter 10 through the roof vent device 100 using fasteners. These can be secured by any means known to one with skill in the art.

The roof vent device 100 further comprises at least one arm 120 extending away from the base 102 for separating the rafter 10 from the ceiling or roof sheeting 14. The roof vent device 100 could have one, two, or any number of suitable arms extending from the base 102. For example, as shown in the accompanying figures, a first arm 120 may extend substantially parallel to a second arm 120, each arm 120 extending from each side flange 106. In other embodiments, only one arm or multiple arms may extend from the base 102. Alternatively, the arms may not extend in co-planar relation to the side flanges 106. For example, the arms may extend outwardly relative to the side flanges 106, inwardly, or at any other suitable angle. Any number of suitable embodiments are envisioned as will be known to one with skill in the art.

The roof vent device 100 may further comprise a web 122 connecting the first and second arms 120. The web 122 may further be generally parallel to the base 102 for providing a passage for fluid flow as shown in the accompanying figures. In other embodiments, the web 122 may bridge the first and second arms 120 at an angle relative to the base 102.

The at least one arm 120 has apertures 130 for providing for fluid flow. In the illustrated embodiments, the roof vent device 100 is formed of metal. Accordingly, the apertures 130 may be perforations or grated metal as shown in the accompanying figures. The apertures 130 may take on any shape, pattern, or design. For example, the apertures 130 may be circular, ovoid, rectangular or any other shape. The apertures 130 may also form a repeat pattern as shown by the grating in the figures, or they may be arranged to form a non-repeating or other design. Further, although shown as metal, the roof vent device 100 may be formed of any other suitable material that can meet the basic requirements of supporting a roof as will be known to one with skill in the art.

The web 122 may further have apertures as described above for providing for fluid flow. Thus, in use, air may flow as shown by the arrows in FIGS. 3 and 4 through the roof vent device 100.

The base 102 and the side flanges 106 may be integral. Further the arms 120 and the base 102 may be integral. The web 122 and the base 102 may further be integral. Thus, the roof vent device 100 may be of unitary construction.

Advantageously, the roof vent device 100 can be used in conjunction with current industry best practices to aid in improving overall roof ventilation with minimal labor. By installing the roof vent device 100 in areas requiring more ventilation, communication between rafter bays can be achieved. The roof vent device 100 can be applied to any rafter, jack rafter, hip rafter, valley rafter, or any part of a complex roof structure. For example, it can be applied to double or triple hip or valley rafters with the device being double or tripled in its application as well, permitting air to flow between the roof deck and insulation in vertical and horizontal directions.

Figure 3:
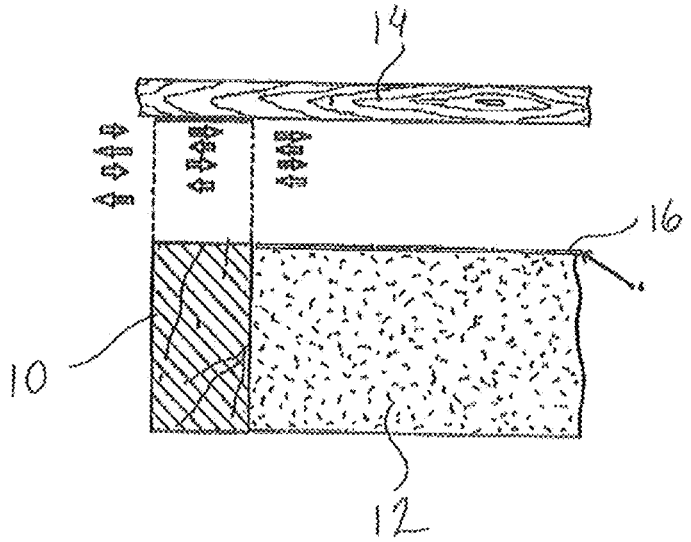
FIG. 3 shows a cross-sectional view of the roof vent device of FIG. 1 in use.
Figure 4:
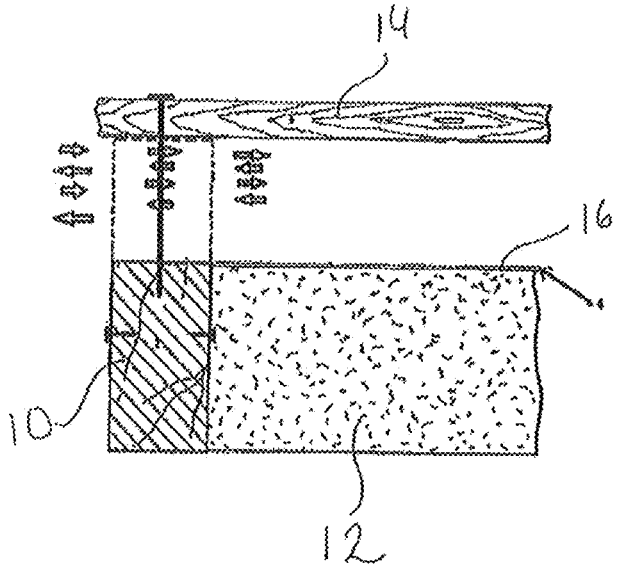
FIG. 4 shows a cross-sectional view of the roof vent device of FIG. 1 secured to a roof rafter.
Figure 5:
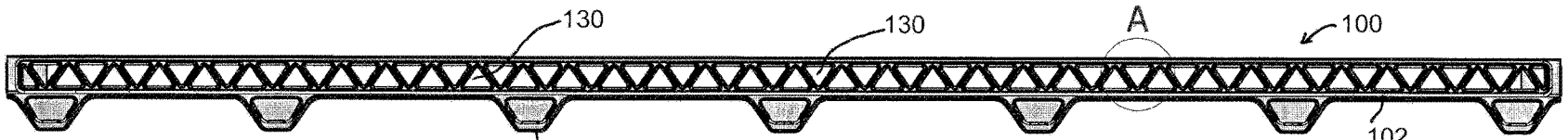
FIG. 5 is a side elevation of an alternate embodiment of the roof vent device.
Figure 6:
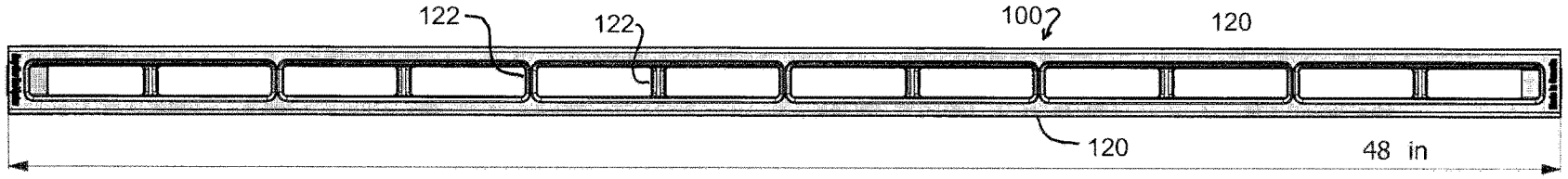
FIG. 6 is a top plan view of the roof vent device of FIG. 5.
Figure 9:
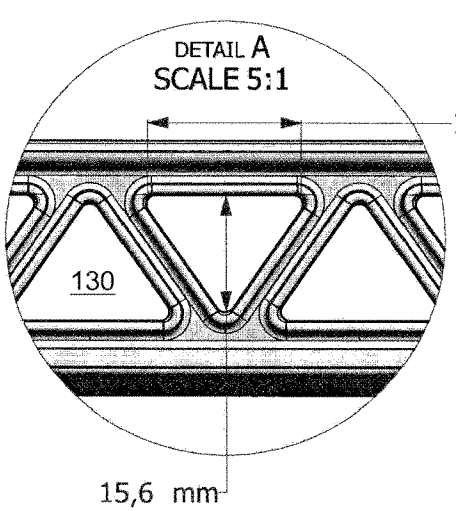
FIG. 9 is an enlargement of the encircled area A in FIG. 5.
Figure 8:
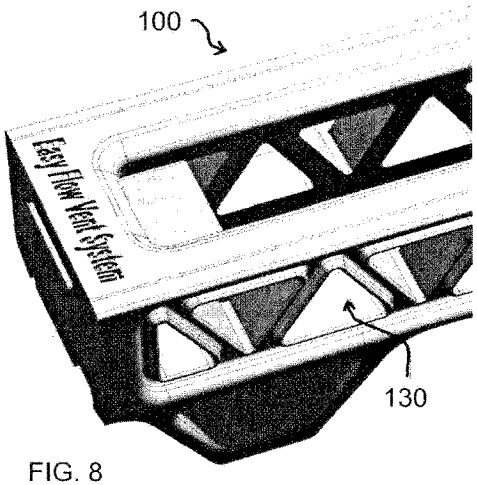
FIG. 8 is a perspective view from above of an end of the roof vent device of FIG. 5.
Figure 7:
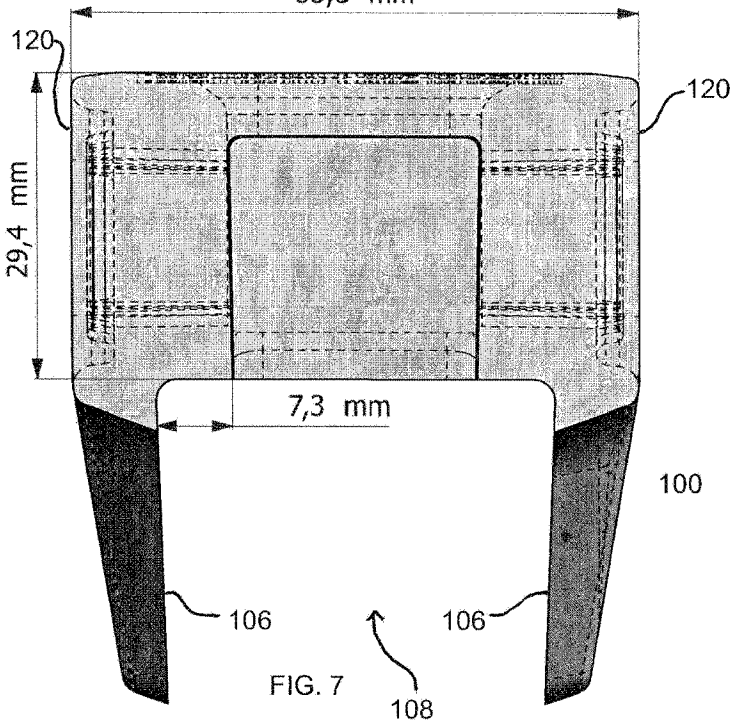
FIG. 7 is an end elevation of the roof vent device of FIG. 5.
Figure 11:
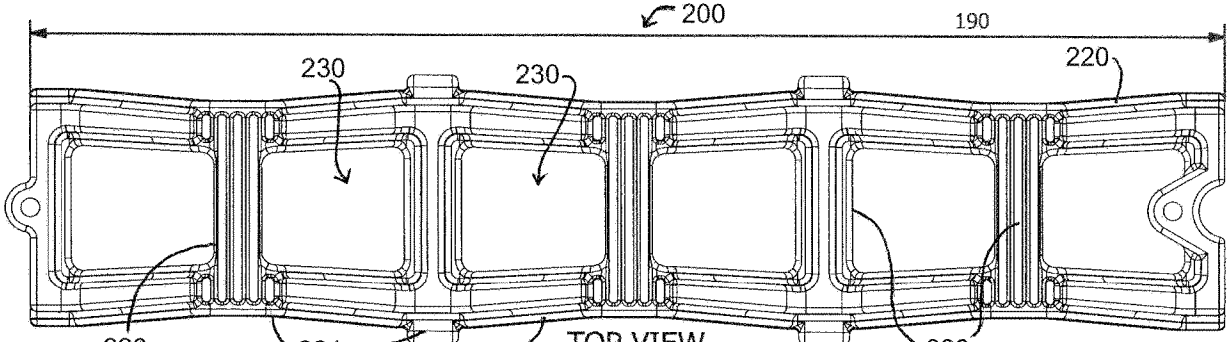
FIG. 11 is a top plan view of the roof vent device of FIG. 10.
Figure 13:
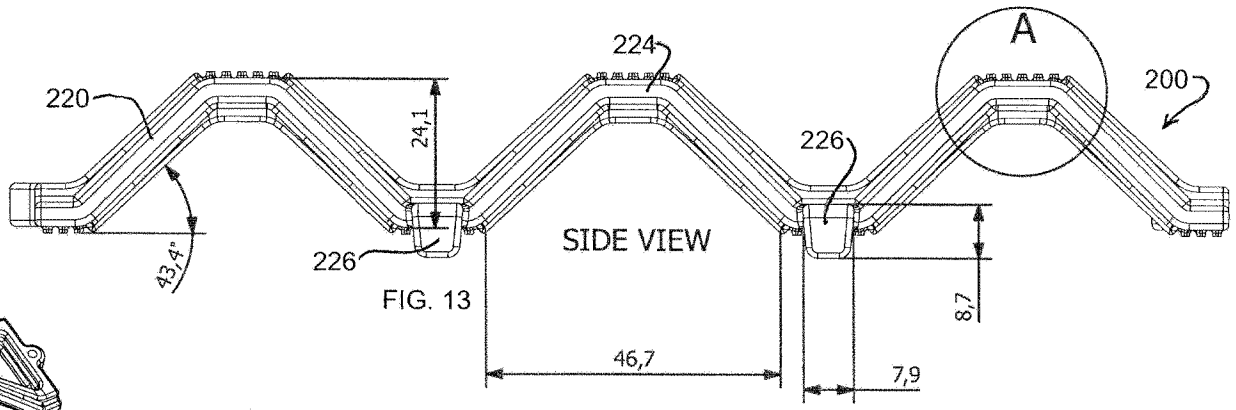
FIG. 13 is a side elevation view of the roof vent device of FIG. 10.
Figure 12:
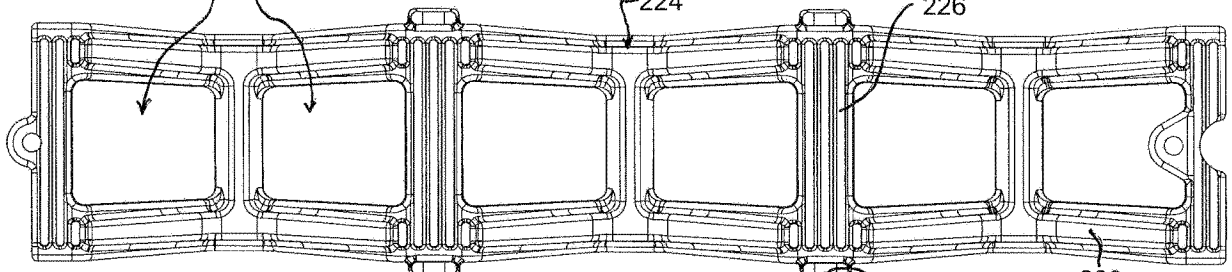
FIG. 12 is a bottom plan view of the roof vent device of FIG. 10.
Figure 15:
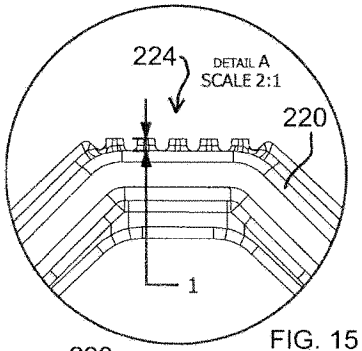
FIG. 15 is an enlargement of the encircled area A in FIG. 11.
Figure 14:
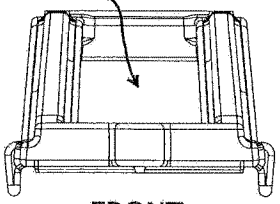
FIG. 14 is an end elevation view of the roof vent device of FIG. 10 taken at line A-A.

As shown in FIGS. 3 and 4, the roof vent device 100 can be placed on a roof rafter FIGS. 5 through 9 illustrate an alternate embodiment of a roof vent device according to the present invention which is structurally analogous to the roof vent device of FIGS. 1 through 4. Accordingly, analogous components have been identified with similar reference numerals and the above description applies.

The embodiment of the roof vent device 100 of FIGS. 5 through 9 is designed as a moldable structure and may be formed from any suitable plastics material. Instead of having continuous side flanges 106 extending along the entire length of the roof vent device 100, the side flanges are segmented into sections, in effect having the appearance of pairs of legs for straddling a rafter.

Figure 10:
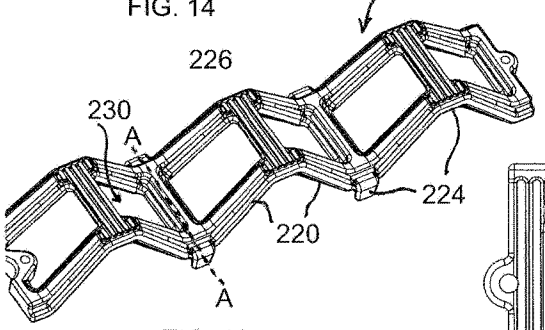
FIG. 10 is a perspective view of an alternate embodiment of the roof vent device.
Figure 16:
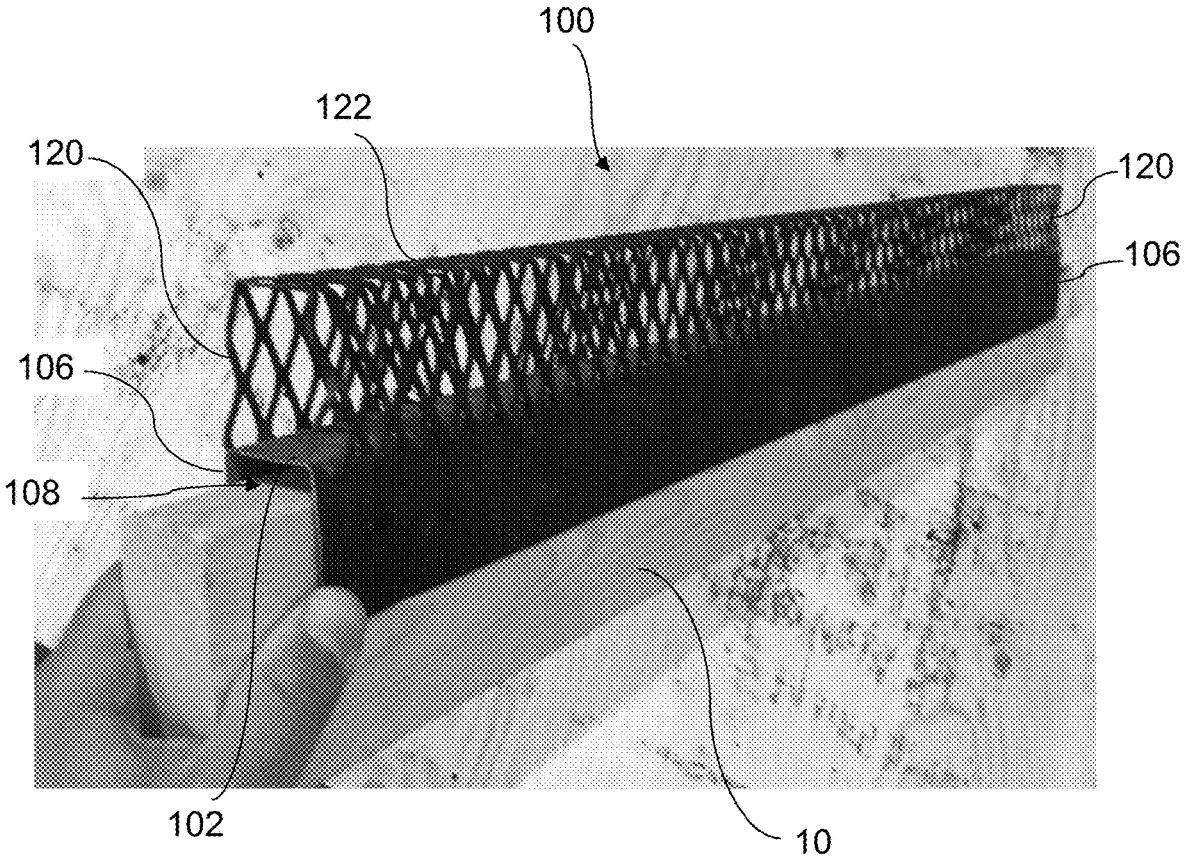
FIG. 16 is a perspective view of a roof vent device secured to an uninstalled rafter in accordance with an embodiment of the present invention.

FIGS. 10-15 show yet another embodiment of a roof vent device according to the present invention. For example, FIG. 10 shows a perspective view of an embodiment of the roof vent device shown by reference numeral 200 having at least two arms 220 extending in parallel in an angled formation, for example, a repeating V-formation, forming angled joints 224. A spacer 226 extends between opposing angled joints 224 for joining the at least two arms 220. Apertures 230 are formed between the at least two arms 220 and the spacers 226.

The apertures 230 may be defined in a generally square interior shape as shown in accompanying FIGS. 10-15 formed by the connection between the spacers and at least two arms. Alternatively, the apertures 230 may take an alternative interior shape such as circular, triangular, rectangular, ovoid or any other suitable shape. As described above, the apertures 230 may take a repeating shape or be of variant shapes.

While the accompanying FIGS. 10-15 show two arms 220 generally in parallel zig-zag fashion, more arms may be present generally in parallel with spacers therebetween defining additional apertures.

Optionally, a base 102 as above-described may also extend across the roof vent device 100 such that it is connected to the arms 220 at the spacers 226.

Figure 17:
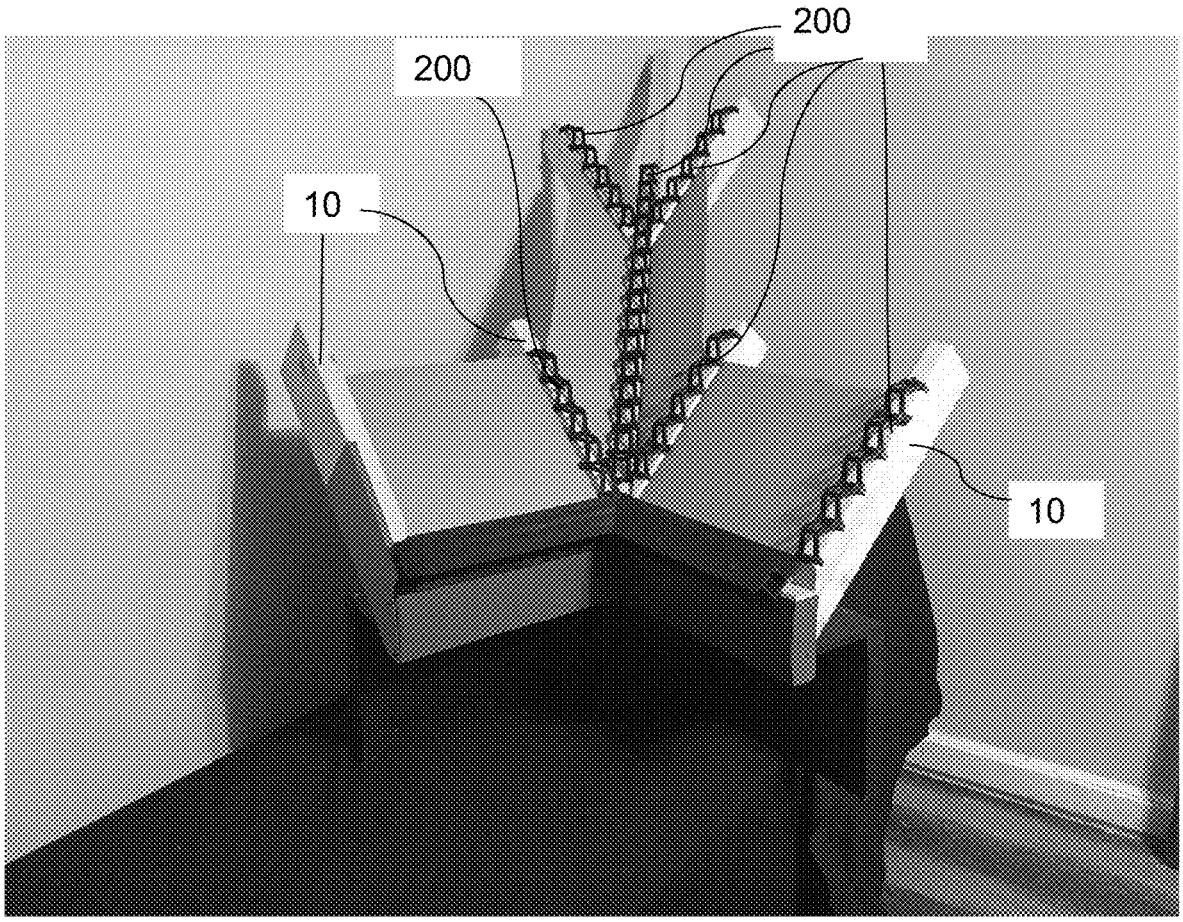
FIG. 17 is a perspective view of a model showing roof vent devices secured to rafters in accordance with an embodiment of the present invention.
Figure 18:
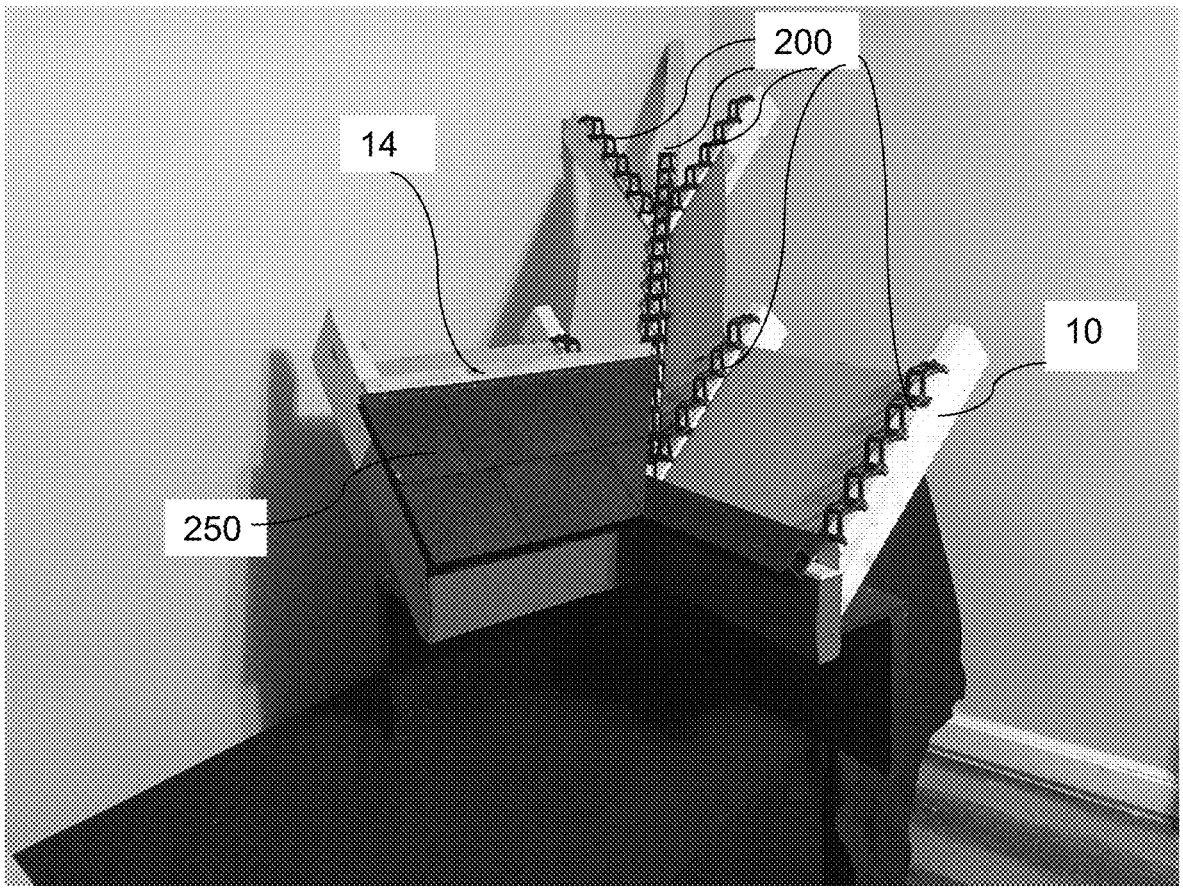
FIG. 18 is the model of FIG. 17 with a number of model shingles installed.
Figure 19:
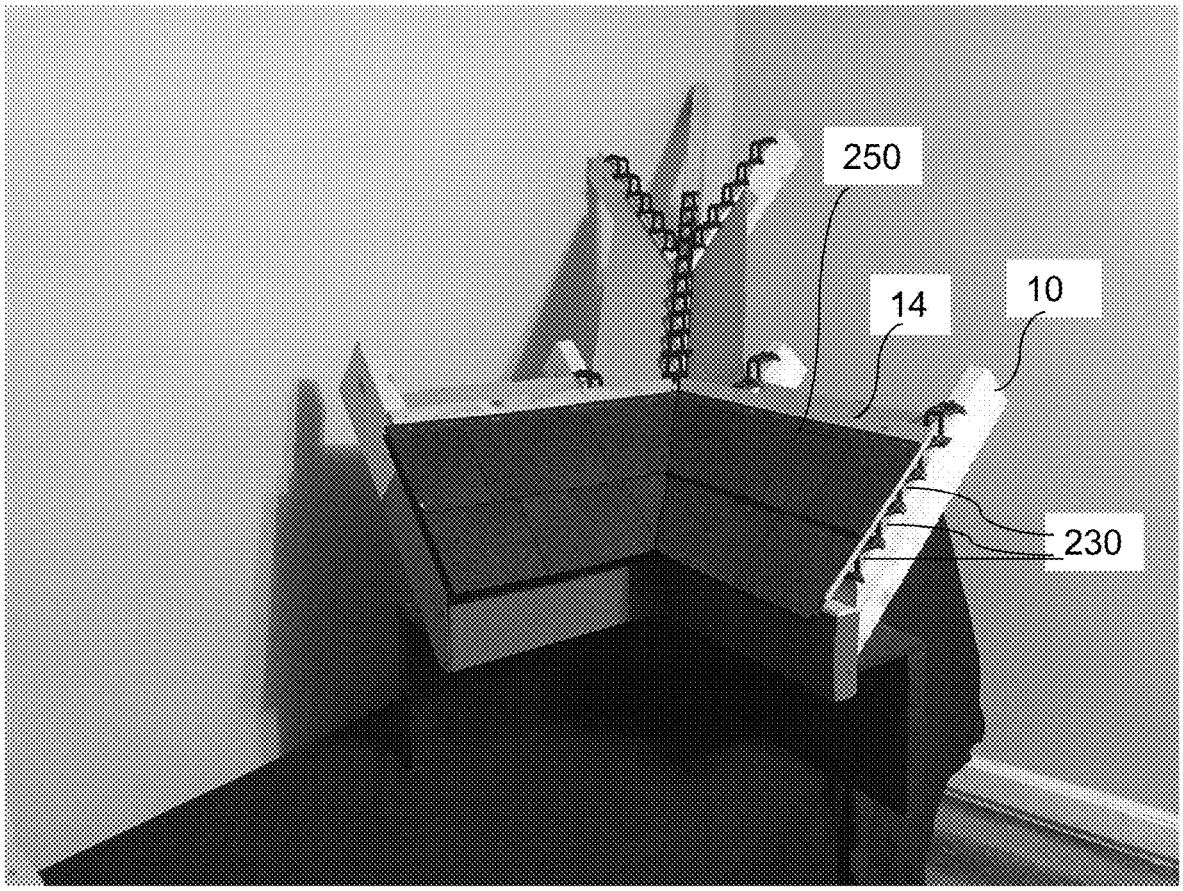
FIG. 19 is the model of FIG. 18 with an additional model shingles installed.

FIGS. 17-19 show a model of an installation set-up using roof vent devices 200 installed on rafters 10 according to an embodiment of the present invention. FIG. 17 shows the installation model without sheeting or shingles installed. FIG. 18 and FIG. 19 show the installation model with roof sheeting 14 and shingles 250 installed. The apertures 230 providing ventilation to the roof are visible in FIG. 19.

Figure 20:
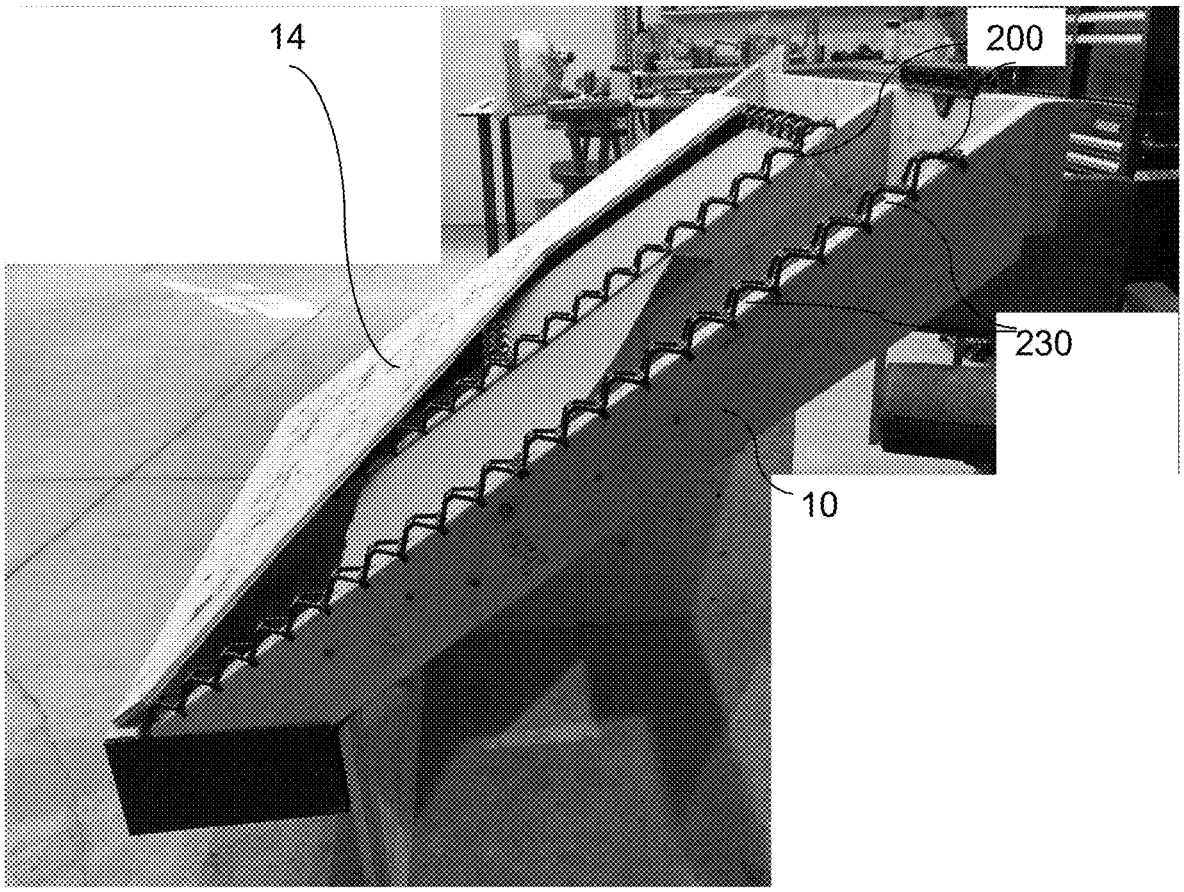
FIG. 20 is a partially cut away side perspective view of a mock-up of roof vent devices installed on rafters in accordance with an embodiment of the present invention.
Figure 21:
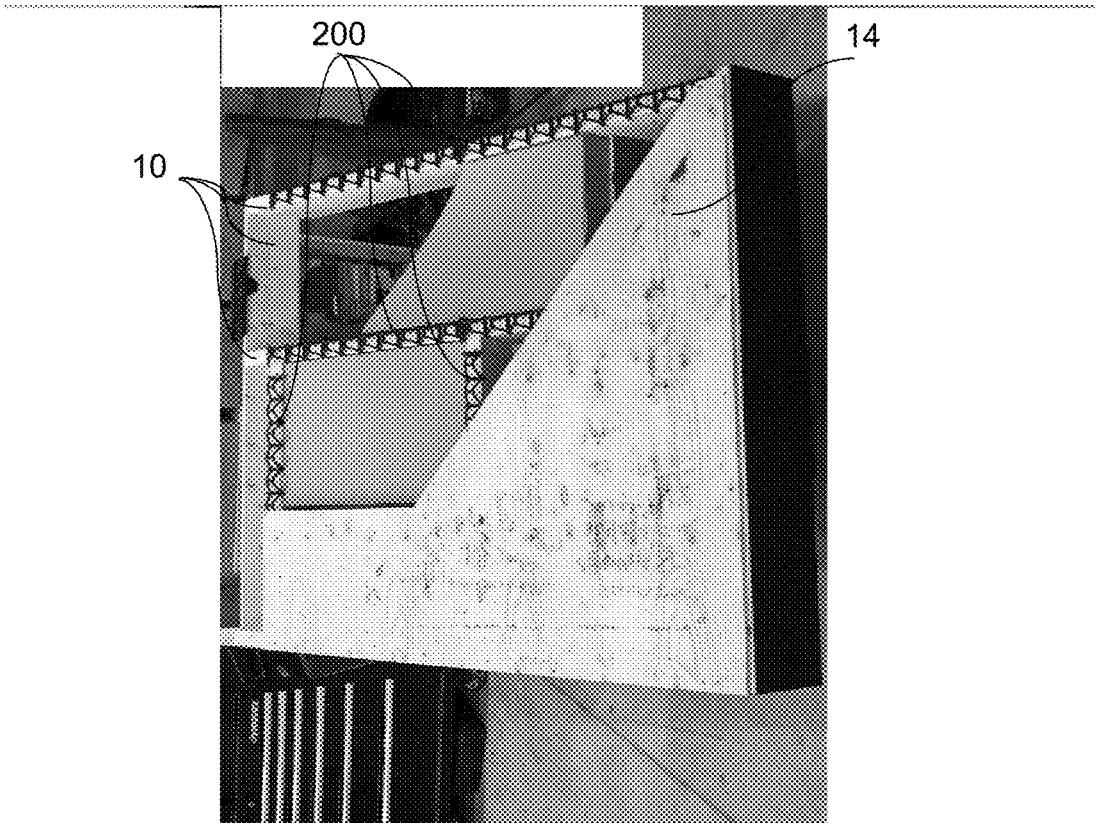
FIG. 21 is a top view of the mock-up of FIG. 20.

FIGS. 20 and 21 show a partially cut away side perspective view of a mock-up of roof vent devices 200 installed on rafters 10 (both vertically and horizontally extensing) in accordance with an embodiment of the present invention. Roof sheeting 14 is shown partially installed and spaced from the rafters 10 by the roof vent devices 200.

Figure 22:
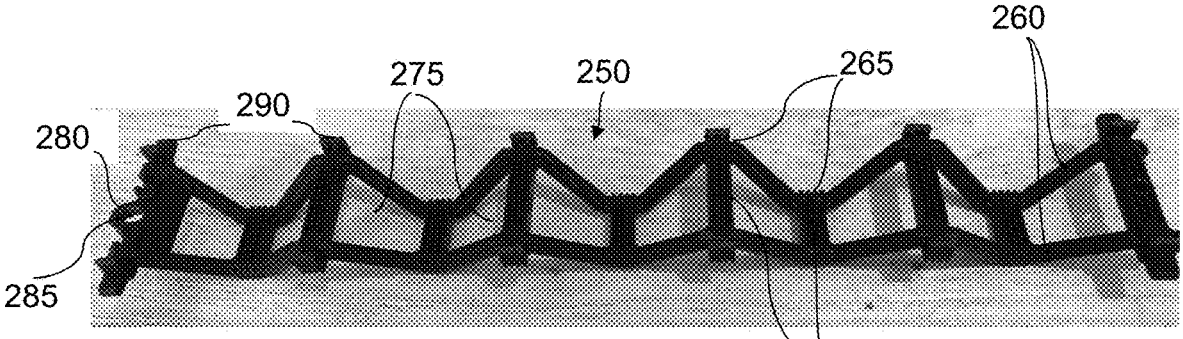
FIG. 22 is a top perspective view of an uninstalled wall spacer device according to another embodiment of the present invention.

In an alternate embodiment, a modified roof vent device can be installed on wall studs or other type of wall framing members of a wall on the interior of a house or building and used to space dry wall or other type of wall panel from the studs. A modified spacer device according to one embodiment of the present invention is shown in FIG. 22 and indicated generally at 250. The spacer device 250 includes two arms 260 extending in parallel in an angled formation, for example, a repeating V-formation, forming angled joints 265. A spacer 270 extends between opposing angled joints 265 for joining the at least two arms 260. Apertures 275 are formed between the at least two arms 260 and the spacers 270. At least one mounting plate 280 with an opening 285 for a fastening device (not shown) such as a screw is provided to fasten the spacer device 250 to a stud. The spacer device is installed on a stud in an analogous manner to installing device 200 on a rafter with dry wall placed over the spacer device 250 in an analogous manner to roof sheeting. The spacer device 250 in one embodiment can be used for net zero applications by placing the device 250 on studs having a vapour barrier installed thereon and then placing drywall or other type of wall board on the installed devices 250. For installation on studs having a vapour barrier installed, the feet 290 which straddle the studs are suitably shortened and sharp edges rounded as compared to on the roof vent device 200 so as not to puncture the vapour barrier when the device 250 is installed. Spacing drywall or other type of wall board from the studs allows electrical wiring and plumbing piping to be run behind the wall and through the apertures 275 without the need to pierce the vapour barrier or the studs. Some or all of the spacers and arm may be integral. Therefore the roof vent may of unitary construction. The roof vent may be formed of metal, plastic, or any other suitable material for supporting a roof as will be known to one with skill in the art.

One or more currently preferred embodiments have been described by way of example. It will be apparent to persons skilled in the art that a number of variations and modifications can be made without departing from the scope of the invention as defined in the claims.

10 rafter
12 insulation
14 roof sheeting
16 baffle
100 roof vent device
102 elongated base
106 side flange
120 arm
122 web
130 aperture
200 roof vent device
220 arm
224 angled joints
226 spacer
230 aperture

What is claimed is:

1. A roof vent device for use with a ceiling rafter, said roof vent comprising:

at least two arms extending generally in spaced parallel relation, each arm formed with angled joints forming a series of peaks and valleys, with the peaks and valleys of the at least two arms aligned with each other;

spacers joining the at least two arms at the aligned peaks and valleys; and said at least two arms having apertures for providing for fluid flow, wherein in use, the device spaces the ceiling rafter from roof sheeting.

2. The roof vent device of claim 1, wherein the two arms form a skeletal structure.

3. The roof vent device of claim 2, wherein the two arms extend generally in parallel in a zig-zag formation.

4. The roof vent device of claim 1, wherein the apertures are of repeating shapes.

5. The roof vent device of claim 1, further comprising a hole on the spacers at each end of the device, the hole adapted for receiving a fastener for fastening the device to the ceiling rafter.

6. A roof structure comprising roof sheeting and ceiling rafters, and further comprising:

a roof vent device installed on the ceiling rafters, the roof vent device comprising:

at least two arms extending generally in spaced parallel relation, each arm formed with angled joints forming a series of peaks and valleys, with the peaks and valleys of the at least two arms aligned with each other;

spacers joining the at least two arms at the aligned peaks and valleys; and the at least two arms having apertures for providing for fluid flow, wherein, the roof vent device spaces the ceiling rafter from the roof sheeting to permit fluid flow for ventilation of the roof structure.

7. The roof structure according to claim 6, further comprising a hole on the spacers at each end of the device, the hole adapted for receiving a fastener for fastening the device to the ceiling rafters.

* * * * *